US005368512A

United States Patent [19]

Brown

[11] Patent Number: 5,368,512

[45] Date of Patent: Nov. 29, 1994

[54] INFLATABLE SWIMMER'S SAFETY BELT

[76] Inventor: Dennis Brown, 22 Bayonne Ave., Monmouth Beach, N.J. 07750

[21] Appl. No.: 78,813

[22] Filed: Jun. 21, 1993

[51] Int. Cl.[5] ..... B63C 9/16

[52] U.S. Cl. ..... 441/108; 441/113

[58] Field of Search ..... 441/41, 94, 106, 108, 441/13-117, 119, 120, 122, 123

[56] References Cited

U.S. PATENT DOCUMENTS

| | | | |
|---|---|---|---|
| 3,754,731 | 8/1973 | Mackal et al. | 441/41 |
| 4,626,221 | 12/1986 | Rocco | 441/113 |
| 5,178,569 | 1/1993 | Wang | 441/88 |
| 5,180,321 | 1/1993 | Brown | 441/108 |

FOREIGN PATENT DOCUMENTS

| | | | |
|---|---|---|---|
| 2573382 | 5/1986 | France | 441/108 |
| 2184069 | 6/1987 | United Kingdom | 441/108 |

*Primary Examiner*—Jesus D. Sotelo

*Attorney, Agent, or Firm*—Charles I. Brodsky

[57] ABSTRACT

A first belt of the invention—substantially hollow and worn about the waist—is able to be filled with a compressed gas from a cartridge coupled with it and actuable by a pin whose placement is controlled by a pulling open of a belt buckle or by a pulling on an included lanyard. A portion of this first belt is secured in overlapping relationship so as to unfold and expand outwardly under action of the compressed gas which fills it. A second belt of the invention—of conventional construction and also worn about the waist—underlies the first belt and is tethered to it. The end result is to increase the length of the first belt when filled with the compressed gas, thereby forming a tube riding under the armpits in holding a wearer vertically in the water—yet still allowing him or her to be able to swim about, while the tether prevents the tube thus formed from slipping over the shoulders and head of the wearer.

15 Claims, 4 Drawing Sheets

INFLATABLE SWIMMER'S SAFETY BELT

FIELD OF THE INVENTION

This invention relates to an inflatable swimmer's safety belt and, more particularly, to one which can effectively be used in both a fresh-water and salt-water environment.

BACKGROUND OF THE INVENTION

My U.S. Pat. No. 5,180,321, issued Jan. 19, 1993, and entitled "Swimmer's Safety Belt" describes a substantially hollow belt, worn about the waist, and able to assume the shape of a lifepreserver in use, while allowing the wearer to swim to safety using whatever swim strokes are convenient. As there set forth, a cartridge is employed, to fill the belt with compressed gas in allowing the lifepreserver so formed to rise up to the wearer's arm level.

SUMMARY OF THE INVENTION

As will become clear from the description that follows, the inflatable swimmer's safety belt of the present invention goes further in two regards. First, a feature is provided which restricts the lifepreserver arrangement to rise only up to, and under, the armpits in holding a wearer vertically in the water, and obviates the possibility of the lifepreserver moving over the shoulders and head of the wearer in somehow possibly coming free. As will also be seen, a second feature of the invention is to minimize the use of adhesive securements for the belt when temporarily held in overlapping relationship—prior to deployment—as analysis has determined that many of the commonly used adhesives tend to deteriorate under exposure to ultraviolet rays, and deteriorate rapidly in a salt-water environment—as where a wearer might fall from a boat, jet-ski, or other watercraft utilized in a sea-water realm.

More specifically, and as will be seen from the description below, the present invention employs a pair of belts tethered together. In the preferred embodiment set forth, a first belt—substantially hollow and worn about the waist—is able to be filled with a compressed gas from a cartridge coupled with it and actuable by a pin whose placement is controlled by a pulling open of a belt buckle or by a pulling on an included lanyard. This first belt, like the one described in my prior United States patent, is secured in overlapping relationship so as to enfold and expand outwardly under action of the compressed gas which fills it. A second belt of this invention is further provided—of conventional construction and also worn about the waist—, to underlie the first belt, yet being tethered to it. As will be understood by those skilled in the art, the end result of such combination is to increase the length of the first belt when filled with the compressed gas, thereby forming the lifepreserver tube to ride under the armpits in holding the wearer vertically in the water; however, with the tether attachment, the tube will thus be tied to the second belt, and at a length which prevents the tube from slipping over the shoulders and head of the wearer, even while still allowing him or her to be able to swim about.

As will also be described, the second belt of this invention is coupled as part of an enclosure in which the first, substantially hollow belt is retained, prior to its automatic filling under action of the compressed gas once the cartridge is pierced. The arrangement will be appreciated to be such that a closing of each belt about the waist of the wearer—each with its own closable clasp—serves to maintain the first, substantially hollow belt in folded, overlapping relationship (able to unfold and expand outwardly under action of the compressed gas) without the need for any adhesive securement, albeit only a temporary one.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
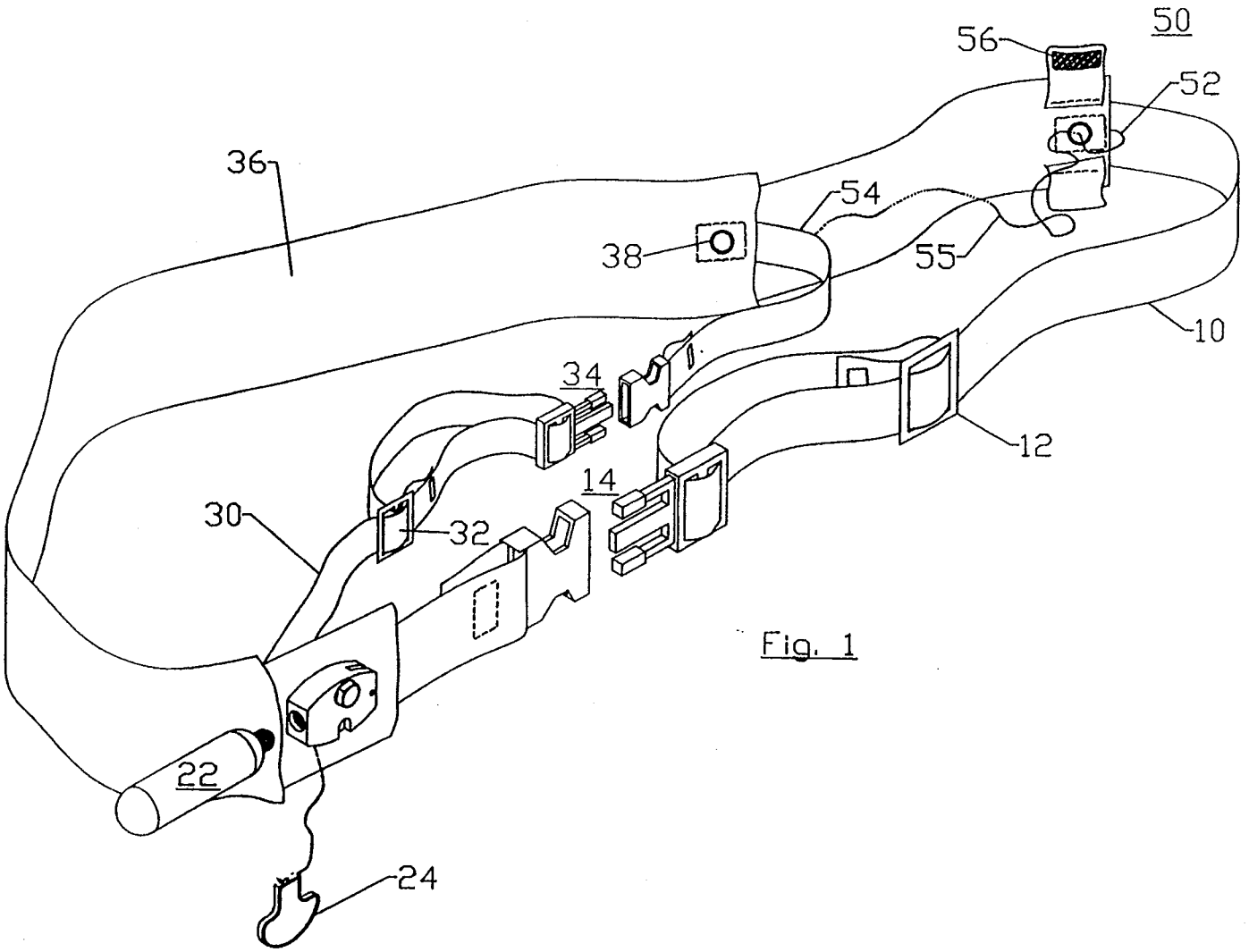
FIG. 1 schematically illustrates, in perspective view, an inflatable swimmer's safety belt constructed in accordance with the teachings of the invention.

Referring to FIGS. 1–4, the inflatable swimmer's safety belt of the invention incorporates a first, substantially hollow belt 10, constructed of a rugged nylon, polyurethane-coated material or similar leak-proof composition and adjustable in length in any appropriate manner by clip 12, and closable by a clasp arrangement, for example, 14. As will be appreciated, the arrangement of the clip 12 and the clasp 14 is such as to enable the size of the belt 10 to be adjusted, i.e., to fit the length of the belt 10 so as to encircle the waist of a wearer. As will be particularly seen from FIG. 3, the belt 10 is provided with folded, overlapping sections 16 which, when eventually deployed are pinched-off into separate interconnecting sections **18*a*–18*e* as an illustration (FIG. 4), at predetermined intervals 20** along its length.

Also shown in the drawings, as by reference notation 22, is a compressed gas cartridge of a well known type, puncturable by a pin (not shown) movable with respect to the cartridge 22. As will be appreciated, the cartridge 22 is further coupled with the belt 10 so as to discharge its compressed gas when punctured, and so as to fill the belt 10—and its sections **18*a*–18*e*—in the nature of a tube, similar to a lifepreserver. A compressed gas cartridge of this type, puncturable by a pin actuator and with a cartridge which can be removably coupled and replaced after use, is shown and described in U.S. Pat. No. 3,754,731. A carbon dioxide compressed gas cartridge 22** may be employed.

Any type of device may be employed to actuate the pin in puncturing the cartridge 22 to discharge its compressed gas. In FIG. 1, for example, a lanyard 24 may be "jerked" to cause the pin movement to puncture the cartridge (FIG. 1), as described in U.S. Pat. No. 3,754,731. In a second configuration—as illustrated in FIG. 2—a separate "buckle-lift" arrangement 26 may be employed, whereby an "upwards-pulling" can cause the actuation to puncture the cartridge, in a manner similar to that described in my aforementioned United States patent.

With either method of actuation—and as so far described —the belt 10 may be worn by a swimmer, or simply as a safety belt by an occupant of a watercraft, and when adjusted for comfort and size by the clip 12 (or by any other type of clip and clasp arrangement 14) closes to fit the waist of the wearer, with the compressed gas cartridge 22 then sealed. If the swimmer wearing such belt then finds himself or herself in difficulty in the water—or if the occupant of the watercraft wearing such belt inadvertently falls out into the water—the lanyard 24 or pull 26 can be "jerked" or "lifted" accordingly, so as to cause the puncture of the cartridge 22 and the automatic filling of the hollow belt 10 and its sections 18*a*–18*e* as a lifepreserver.

Figure 3:
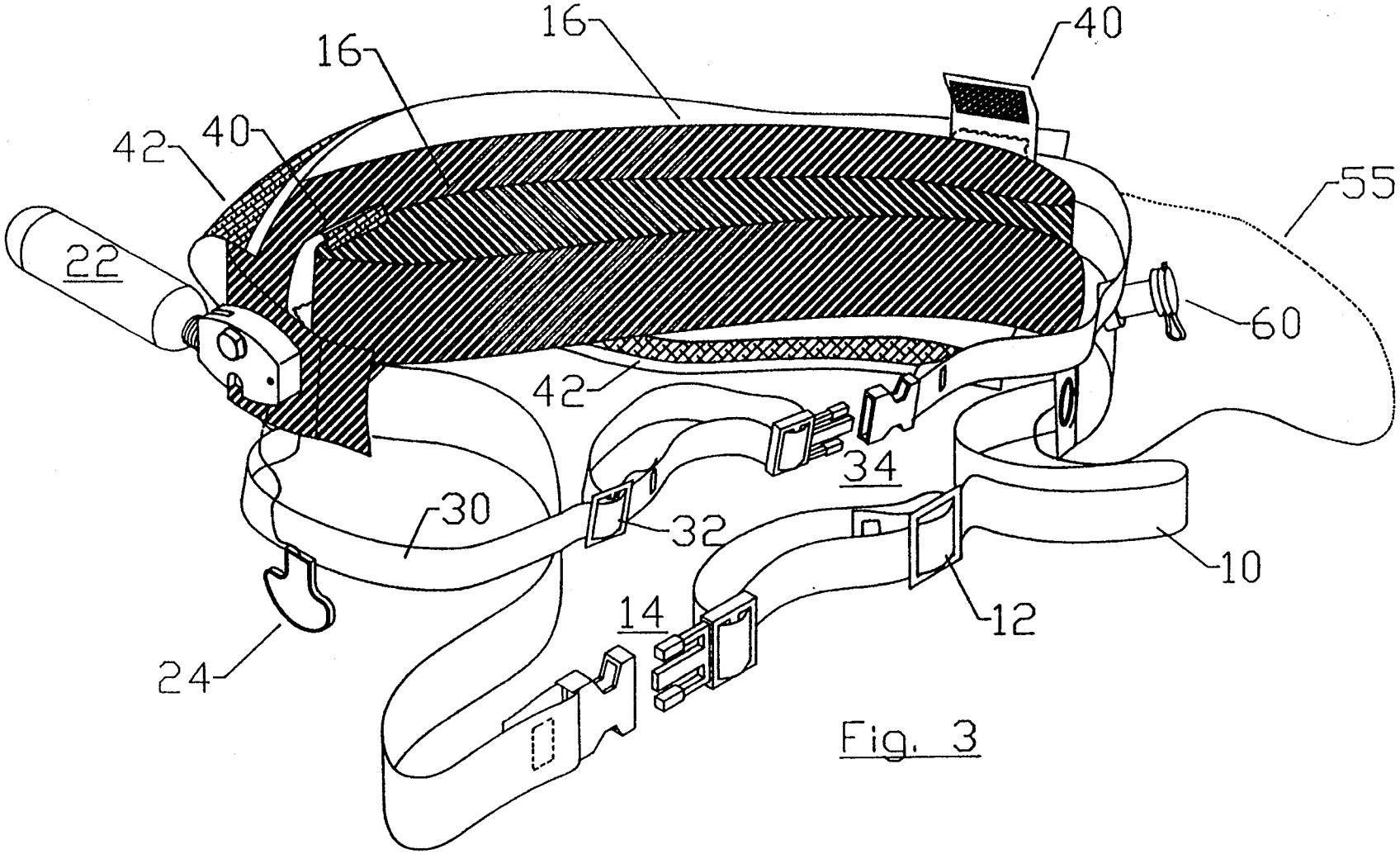
FIG. 3 is a perspective view, schematically showing the manner by which the first, substantially hollow belt is temporarily stored within the enclosure forming part of the second belt of the invention.
Figure 4:
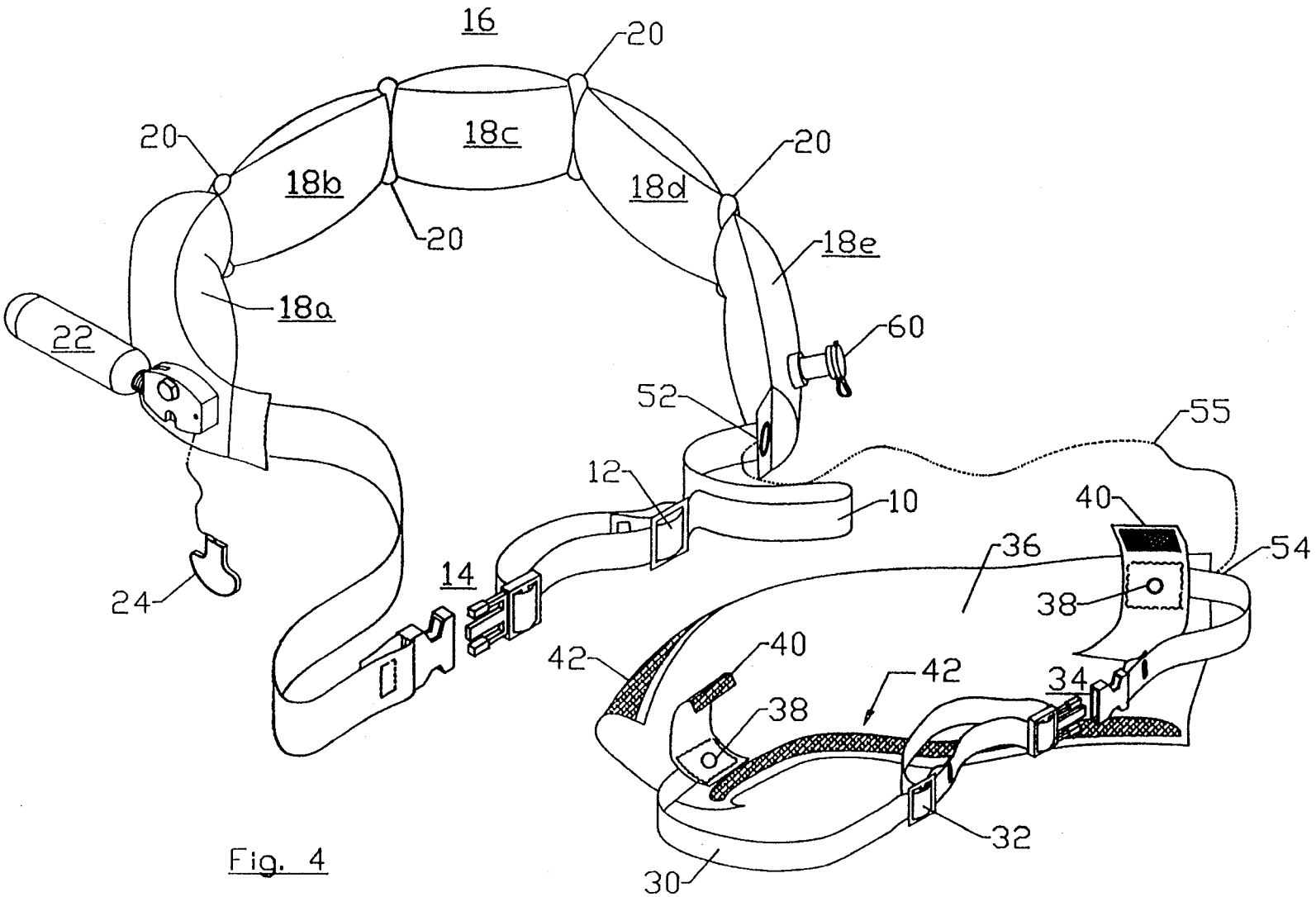
FIG. 4 is a perspective view of the two belts displaced, but tethered together, helpful in an understanding of the invention.

In accordance with the teachings of the present invention, on the other hand, a second belt 30 is also provided, similarly constructed of a rugged nylon, polyurethane-coated material or similar leak-proof composition, adjustable in length in any appropriate manner, as by the clip 32 and clasp 34 to encircle the waist of the wearer. As will be appreciated, this second belt 30 is of a conventional construction to be worn about the waist, underlying the first belt 10, and contradistinct therefrom in not being hollow or sectionalized as at 18*a*–18*e*. Moreover, and as illustrated in FIGS. 1, 2 and 4, this "conventional" belt 30 forms part of an enclosure 36 which fits about the waist of a wearer at the small of the back and within which the overlapping folds 16 of the first belt 10 are temporarily secured (FIG. 3). To such end, and as shown in FIGS. 1, 2 and 4, the ends of the second belt 30 are fixedly secured at 38—as by a "tacking"—, and including a Velcro or other adhesive fastener 40 in temporarily holding the folded sections 16 of the belt 10 in place prior to deployment—in which event the unfilled sections 18*a*–18*e* are enveloped within the enclosure 36, and hidden from sight, thereby forming a portion of the first belt 10 at the small of the wearer's back (i.e. within the enclosure 36 of FIGS. 1 and 2). Reference notation 42 in FIGS. 3 and 4 will be understood to be separate Velcro, or other adhesive securements in wrap-over, and envelop the sections 18*a*–18*e* within the enclosure 36, before the puncture of the compressed gas cartridge.

Figure 2:
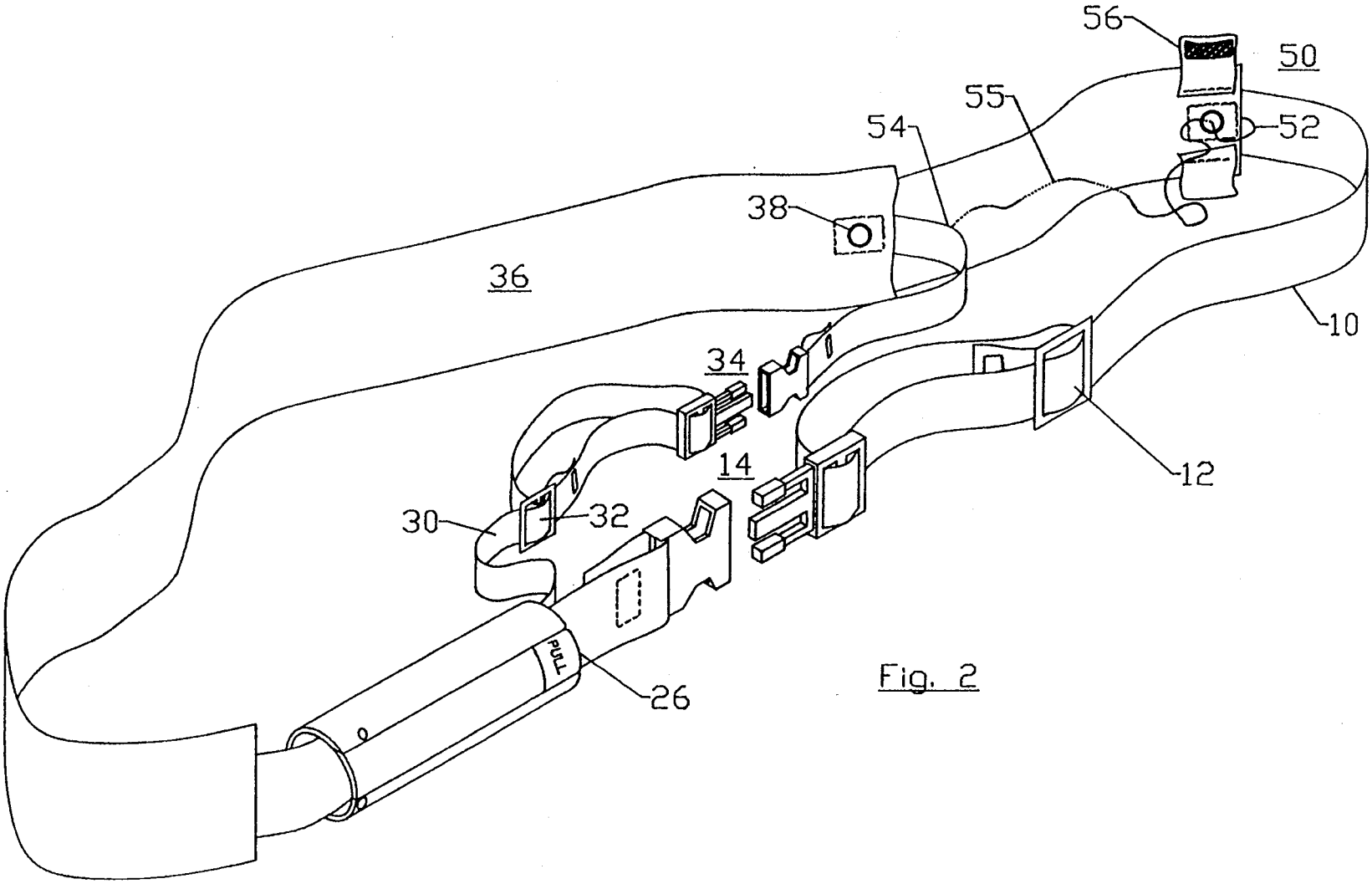
FIG. 2 schematically illustrates, in perspective view, a modified version of the inflatable swimmer's safety belt of FIG. 1 according to the invention.

Except for the description of the tether arrangement 50 and its component parts to be described below, the inflatable swimmer's safety belt of the invention will be appreciated to take on the appearances of FIGS. 1 and 2, wherein the first belt 10 overlies the second belt 30, about the waist of the wearer, at the small of the back, and with the temporarily secured, folded, overlapping unfilled sections 18*a*–18*e* enveloped within the enclosure 36—all as shown in FIGS. 1 and 2.

As will be understood by those skilled in the art, upon actuation of the lanyard 24 or pull 26 of FIGS. 1 and 2 respectively, the compressed gas in cartridge 22 will be appreciated to not only fill the belt 10 and/or its sections 18*a*–18*e*, but will also act to unfold and expand outwardly the folded-over sections 18*a*–18*e*, previously held within the enclosure 36. More specifically, the filling by the compressed gas which is released will be seen to unfurl the Velcro sections 42, so as to increase the length of the belt 10, to free it from the enveloping confines of the enclosure 36, and to form the lifepreserver of increased length which results so as to permit the belt 10 to raise over the chest area to the wearer's arm level—done automatically as the inflated sections 18*a*–18*e* ride up in the water. Depending upon the amount of the hollow belt 10 initially overlapped, and on the amount of the belt 10 devoted to receive the inflating gas, the unfolding and outward expansion of the belt 10 can be predetermined, to allow the belt to ride under the armpits of the wearer, and to thereby hold the wearer substantially vertical in the water. In a preferred embodiment of the invention, the overlapping belt portions 18*a*–18*e* were selected so that with a carbon dioxide compressed gas cartridge 22, the length of the belt 10, when filled, increased by approximately 10 inches, to allow the belt 10 to rise to the armpits of the wearer, from its initial position at the wearer's waist.

Further, and in accordance with the teachings of the invention, a tether is further included between an underside surface of the belt 10 (as at 52) and a topside surface of the belt 30 (as at 54). Such a tether is identified by the reference notation 55 in the drawings, and is selected of a length to restrict the upward riding of the belt 10 when expanded to form the tube riding upwardly towards the arm level of the wearer. In such manner, the tube so formed is prevented from riding over the shoulders and/or head of the user, to become otherwise "free", or to just clear away a sufficient amount to reduce its capacity to hold the user vertical in the water, with the head out-of-the-water. As depicted in FIGS. 1 and 2, the tether 55 may also be temporarily housed by a Velcro or other adhesive securement 56, until the first belt 10 is deployed.

Reference notation 60 in FIGS. 3 and 4 will be appreciated to comprise a removable cap which permits the release of the compressed gas from the sections 18*a*–18*e* when it is desired to refold the belt 10 for placement into the enclosure 36 after use, or to manually fill the sections by wearer's breath, and where the sections 18*a*–18*e* may tend to leak in the event that the inflatable swimmer's safety belt is worn in the water for a prolonged period of time. Although not restricted to the type of arrangement shown in the drawings, it will be appreciated that the preferred embodiments described employ the compressed gas cartridge 22 in position on the belt 10 between the enclosure 36 and the closable clasp 14. In similar manner, and particularly with the type of cartridge 22 described, the compressed gas cartridge 22 may be removably coupled with the belt 10, for replacement after use. Obviously, in order for the inflatable swimmer's safety belt to effectively operate in both fresh-water and salt-water (sea-water) environments, the compressed gas which fills the cartridge 22 is selected of a buoyancy to allow the belt 10 to float in any water environment.

With the invention as thus described, the tether 55 will be noted to prevent the floating belt from going over the wearer's head, once inflated. With the second, conventional belt 30 always clasped about the wearer's waist, appropriately selecting the length of the tether 55 then prevents this from occurring, as the amount of "play" available for the belt 10 is thus limited. With the clasps 14, 34 closed to restrain the enclosure 36 about the small of the back, no need will be seen to exist to provide a temporary adhesive securement of the folded, overlapping relationship of the belt 10, waiting for the compressed gas to fill the interconnected sections 18*a*–18*e* in lengthening the belt 10 in forming the lifepreserver tube. Such elimination of the temporary adhesive securement—whose strength has been noted to weaken in a water environment (and especially in a salt-water environment) —simplifies the manufacture of the safety belt, and concommitantly reduces its manufacturing cost.

While there have been described what are considered to be preferred embodiments of the invention, it will be readily appreciated by those skilled in the art that modifications can be made without departing from the scope of the teachings herein. Thus, whereas the compressed gas cartridge 22 is shown as being coupled to the belt 10 at a position adjacent to its side, the activating pin and its actuator (24 or 26) can be located anywhere along the belt 10, just so long as it can be easily reached to puncture the cartridge. In like manner, as advances continue in the manufacture of compressed gas cartridges, versions of the present invention can also be foreseen where the cartridge 22 would itself, become water activated, as by an accidental falling of the wearer from the boat, jet-ski or other watercraft, and to thus cause such activation to release the compressed gas in filling the substantially hollow belt 10. And, although the safety belt has been described as using a pair of belts 10, 30 of rugged nylon, polyurethane-coated or similar leak-proof composition, it will be understood that all that is necessary is for the belt 10 to be of a buoyancy to float when filled with the compressed gas employed—no matter what manufacture is employed for the belt 10, and no matter whether the compressed gas is of a carbon dioxide, or other, mixture. Also, a comparable modification might utilize a double-chambered version for the belt 10, consisting of two inflatable belts, to afford double securing in the event a cartridge misfires or one of the belts incurs a leakage. For at least such reasons, therefore, resort should be had to the claims appended hereto for a true understanding of the scope of the invention.

I claim:

1. An inflatable swimmer's safety belt comprising:

a first, substantially hollow belt, closable to fit the waist of a wearer;

a compressed gas cartridge coupled with said first belt;

a pin, movable to puncture said cartridge so as to allow said cartridge to fill said first belt with compressed gas;

means, movable between first and second positions, and connected to said pin for moving said pin to puncture said cartridge when moved to said second position;

wherein a portion of said first belt fitting 'the waist of a wearer is temporarily secured in folded, overlapping relationship so as to unfold and expand outwardly under action of the compressed gas which fills it when said means is moved to said second position to puncture said cartridge, thereby increasing the length of said first belt in forming a tube to ride upwardly towards the arm level of the wearer;

a second belt, underlying said first belt, and also closable to fit about the waist of a wearer;

wherein each of said first and said second belts are closable by clasps to fit the waist of a wearer; and a tether, connected between said first and said second belts, of a length to restrict the upward riding of said tube to a predetermined amount.

2. The inflatable swimmer's safety belt of claim 1, wherein said tether is connected between an underside surface of said first belt and a topside surface of said second belt.

3. The inflatable swimmer's safety belt of claim 1, wherein said tether is of a length to restrict the upward riding of said tube to substantially the armpits of a wearer.

4. The inflatable swimmer's safety belt of claim 1, also including an enclosure enveloping said first belt about the waist of a wearer at the small of the back.

5. The inflatable swimmer's safety belt of claim 4, wherein said enclosure is adhesively secured to release said first belt when said first belt fills with said compressed gas.

6. The inflatable swimmer's safety belt of claim 4, wherein said enclosure envelops at least said portion of said first belt of folded, overlapping relationship.

7. The inflatable swimmer's safety belt of claim 4, wherein said compressed gas cartridge is positioned on said first belt between said enclosure and said closable clasp therefor.

8. The inflatable swimmer's safety belt of claim 4, wherein said enclosure also forms a portion of said second belt about the waist of a wearer at the small of the back.

9. The inflatable swimmer's safety belt of claim 4, further including means coupled with said enclosure to adhesively secure said second belt in place when storing away said inflatable swimmer's safety belt.

10. The inflatable swimmer's safety belt of claim 1, also including means cooperating with said first belt to allow the filling thereof by wearer's breath.

11. The inflatable swimmer's safety belt of claim 1, wherein said first belt is pinched off into separate, interconnected sections at predetermined intervals about its length.

12. The inflatable swimmer's safety belt of claim 1, wherein said compressed gas cartridge is removably coupled with said first belt for replacement after use.

13. The inflatable swimmer's safety belt of claim 1, wherein said portion of said first belt in overlapping relationship unfolds under action of the compressed gas which fills it to increase the length of the belt of the order of 10 inches.

14. The inflatable swimmer's safety belt of claim 1, wherein said cartridge is filled with a compressed gas of buoyancy to cause said first belt to float in a water environment.

15. The inflatable swimmer's safety belt of claim 1, wherein said first belt is constructed of a vinyl, polyurethane-coated composition.

* * * * *